US011199378B2

(12) United States Patent
LoRocco et al.

(10) Patent No.: US 11,199,378 B2
(45) Date of Patent: Dec. 14, 2021

(54) PORTABLE APPARATUS AND METHOD FOR ADJUSTING HANDGUN SIGHTS

(71) Applicant: Good Sportsman Marketing, L.L.C., Irving, TX (US)

(72) Inventors: Paul LoRocco, Dallas, TX (US); John Estridge, Garland, TX (US); Damon Lamont Coalson, Dallas, TX (US)

(73) Assignee: Good Sportsman Marketing, L.L.C., Irving, TX (US)

( * ) Notice: Subject to any disclaimer, the term of this patent is extended or adjusted under 35 U.S.C. 154(b) by 0 days.

(21) Appl. No.: 16/936,385

(22) Filed: Jul. 22, 2020

(65) Prior Publication Data

US 2020/0400407 A1 Dec. 24, 2020

Related U.S. Application Data

(60) Provisional application No. 62/864,458, filed on Jun. 20, 2019.

(51) Int. Cl.
*F41G 1/54* (2006.01)
*F41G 11/00* (2006.01)

(52) U.S. Cl.
CPC ..... *F41G 1/545* (2013.01); *F41G 11/003* (2013.01)

(58) Field of Classification Search
CPC ..... F41G 1/545
USPC ..... 42/90
See application file for complete search history.

(56) References Cited

U.S. PATENT DOCUMENTS

| | | | | |
|---|---|---|---|---|
| 2,599,839 | A * | 6/1952 | Keifer, Jr. | F41G 1/26 42/139 |
| 5,388,335 | A * | 2/1995 | Jung | F41G 1/26 42/115 |
| 5,864,957 | A * | 2/1999 | Small | F41G 1/54 42/111 |
| D620,547 | S * | 7/2010 | Bietsch | D22/199 |
| D622,807 | S * | 8/2010 | Stone | D22/199 |
| D675,698 | S * | 2/2013 | Bietsch | D22/108 |
| 8,397,422 | B2 * | 3/2013 | Bietsch | F41G 1/545 42/124 |
| 8,707,609 | B2 * | 4/2014 | Fisher | F41G 1/545 42/124 |
| 8,910,413 | B2 * | 12/2014 | Hillwig, Jr. | F41G 1/545 42/143 |
| 9,464,870 | B2 | 10/2016 | Gomez | |
| 9,593,910 | B1 | 3/2017 | Fisher | |
| 9,784,535 | B1 * | 10/2017 | Cheng | F41G 1/545 |
| D829,294 | S * | 9/2018 | Cheng | D22/108 |

(Continued)

OTHER PUBLICATIONS

Product listing on Amazon.com for "Truglo Sight-setter glock rear sight adjustment tool, black, one size"; reference shows that listing was made available Feb. 27, 2019 (Year: 2019).*

*Primary Examiner* — Samir Abdosh
(74) *Attorney, Agent, or Firm* — D'Ambrosio & Menon, PLLC; Usha Menon

(57) ABSTRACT

A sight adjustment assembly has a frame with a clamping mechanism for receiving and clamping a handgun slide with an attached stationary sight and an adjustment mechanism for engaging and adjusting the sight in a lateral position with respect to the slide. The sight adjustment mechanism and the clamping mechanism are contained within an outer periphery of the frame during storage and use to thereby provide a compact device that can conveniently accompany a user for sight adjustments in the field.

19 Claims, 7 Drawing Sheets

(56) References Cited

U.S. PATENT DOCUMENTS

| | | | | |
|---|---|---|---|---|
| 2011/0167702 | A1* | 7/2011 | Bietsch | F41G 1/545<br>42/90 |
| 2020/0400407 | A1* | 12/2020 | LoRocco | F41G 1/545 |

* cited by examiner

PORTABLE APPARATUS AND METHOD FOR ADJUSTING HANDGUN SIGHTS

CROSS-REFERENCE TO RELATED APPLICATIONS

This application claims the benefit of U.S. Application No. 62/864,458 filed on Jun. 20, 2019, the disclosure of which is hereby incorporated by reference.

BACKGROUND OF THE INVENTION

This invention relates generally to firearm accessories, and more particularly to a portable apparatus and method for adjusting the windage position of a sight mounted on a handgun or the like, so that adjustments can be facilitated in the field without the need for specialized tools or equipment to thereby achieve greater shooting accuracy while in the field.

It is often desirable to adjust the front sight and/or rear sight of a handgun to obtain greater shooting accuracy. Many handgun slides have front or rear sights which are set in a dovetail-shaped groove formed in the slide. The front or rear sight normally includes a dovetail-shaped mounting base that is press-fit into a complementary dovetail-shaped mounting groove formed in the slide. The mounting groove typically extends across the slide in a lateral direction, i.e. a direction perpendicular to the axis of the gun barrel. During manufacture, the position of the front and/or rear sight is adjusted at the factory so that proper alignment is obtained between the front and rear sights with respect to each other and the axis of the gun barrel bore. The front and/or rear sight may then be peened in place by deforming the mounting groove thereby preventing relative movement between the sight and the slide.

Lateral adjustment of the rear sight and/or front sight of handguns or other firearms is often necessary when the sights have not been adequately aligned at the factory, when they become misaligned during transportation or use for various reasons, when changes to the barrel occur, or when greater accuracy is simply desired. The front and rear sights are typically quite small in size and thus can be difficult to adjust, especially when relatively high forces are required to dislodge the sight from its fixed position in the dovetail-shaped mounting groove, and when fine adjustment is required. For example, the rear sight is commonly adjusted by removing the slide from the handgun and securing the slide in a vise with soft inserts to minimize scratches or damage to the slide. The relatively small tip of a steel punch or the like is then positioned against the side of the sight by the user with one hand, while the head of the punch is struck by a hammer with the other hand.

Whether the user is right-handed or left-handed, the requisite precise positioning of the punch tip with one hand while holding it steady, along with the requisite precise control of the hammer direction, velocity, and force with the other hand, while essaying to align the angle of the hammer with the angle of the punch and aiming center of the hammer head with the center of the punch head, often results in what may be felt by many users to be a clumsy task ultimately resulting in injury to the user, damage to the sight, slide, vice, and so on, yet, inadequate for precisely adjusting the windage of the gun sight to ensure that the front and rear sights are perfectly aligned.

Due to the relatively tight tolerances of the dovetail-shaped mounting groove and complementary-shaped sight base, along with the added difficulty of some sights being peened in place during factory installation, striking the punch with sufficient force against the base of the sight to dislodge and move the sight in the lateral direction while avoiding damage to the sight structure or sight components can be difficult to achieve. This is especially true with users having less experience, or in the field where quick adjustment of the sights may not be possible due to the lack of a suitable hard, smooth surface for clamping the slide against movement and/or where sounds associated with adjusting the sight may compromise the user's position or safety.

Prior art techniques for installing, adjusting, and removing the rear sight in the above-described manner can be quite tedious and time-consuming, often forcing the user into an uncomfortable contorted position to visually determine whether the front and rear sights are properly aligned, while attempting to reduce parallax errors due misalignment of the user's line of sight with the front and rear sights. Although some users call for a steel punch with a nylon or brass tip to both withstand hammer blows while minimizing the potential for the punch tip to damage the sight, mishaps do occur. Such mishaps are especially prevalent among sights with delicate features or inserts, including as fluorescent-doped optical fibers, tritium vials, and thin-walled structural or cosmetic portions that can be easily damaged, despite placing the tip of the punch at the base of the rear sight to minimize contact between the punch and the more delicate sight features.

Those who have used the punch-and-hammer technique, whether novices or pros, have recognized the difficulty in attempting to accurately adjust the pair of spaced sight posts of the rear sight with the single post of the front sight. During the procedure, if the sight has moved too far along the groove in a first lateral or windage direction, the punch must be positioned against the opposite side of the sight and struck again to move the sight in a second opposite lateral or windage direction. This adjustment method is often repeated several times until the rear sight is aligned to the satisfaction of the user. This problem is exacerbated when the side of the sight is slanted or of some other shape that would make it difficult to maintain contact between the punch and the sight when the punch is struck.

Although several prior art solutions have been proposed to permit finer adjustment of the rear and/or front sights, they are often universal in nature, i.e. designed with a universal frame to fit many different types of handguns and handgun sights, and therefore have many adjustment features to accommodate different slide configurations and sizes of different handgun models, different types, configurations, and sizes of sights, various front and rear sight combinations, as well as different sight bases and cooperating structure on the slide. Such prior art solutions typically have threaded clamping rods that extend through complementary threaded holes in the walls of the frame with clamping features connected to one end of the threaded rods inside the frame and knobs or hand grips connected to an opposite end of the rods outside of the frame for grasping by a user so that the clamping pressure on a handgun slide can be adjusted. Likewise, when the slide is secured in the frame, a sight adjustment block is mounted on a threaded adjusting shaft via a threaded through-bore in the block. The threaded adjusting shaft in turn extends through opposite sides of the frame and protrudes outwardly therefrom. One end of the shaft can be configured for receiving a torque rod for facilitating rotation of the adjustment screw in opposite directions by a user, causing the sight adjustment block to push the gunsight in opposite directions during adjustment.

The sheer number and size of various rods, shafts, handles and knobs that extend outside of the frame member for one prior art device in particular, is impractical for carrying in a pocket or other article of clothing. Such devices are typically constructed of metal, are usually unwieldy, heavy, require further tools to operate, and thus are typically expensive and impractical to carry into the field where adjustment of the sight may be critical.

It would therefore be desirous to provide a device for precise adjustment of handgun sights that overcomes one or more disadvantages of the prior art.

SUMMARY OF THE INVENTION

In accordance with one aspect of the invention, a compact sight adjustment assembly for adjusting a lateral position of a sight connected to a slide operably associated with a handgun includes a frame with an outer periphery, an enclosed adjusting space located within the frame for receiving a sight connected to the slide, and a sight adjustment mechanism operably associated with the frame and including a sight adjusting portion operably associated with the sight and adapted for movement in a lateral direction with respect to the frame within the enclosed adjusting space for adjusting a lateral position of the sight with respect to the slide. The sight adjustment mechanism is fully contained within the outer periphery of the frame to thereby minimize a size of the compact sight adjustment assembly.

In accordance with a further aspect of the invention, a compact sight adjustment assembly for adjusting a lateral position of a sight connected to a slide operably associated with a handgun includes a frame defining an outer periphery with a lower cross beam, an upper cross beam spaced from the lower cross beam and extending parallel with the lower cross beam, a right side post extending between the lower cross beam and the upper cross beam; and a left side post spaced from the right side post and extending between the lower cross beam and the upper cross beam. A lower clamping portion is located within the outer periphery of the frame and includes a lower clamping channel formed in the lower cross beam for receiving and securing at least one of a rear breech end and a front muzzle end of the slide. A lower internally threaded clamping bore is formed in at least one of the right and left side posts and extends into the channel. A clamping member has external threads formed along a length thereof for engaging the internal threads of the clamping bore. A lower hex-shaped depression is operably associated with the clamping member for engagement with a hex-shaped tool. Likewise, an upper sight adjustment portion is located within the outer periphery of the frame and includes a sight adjustment block having an internally threaded bore, a sight adjustment shaft rotatably connected to the right and left side posts, and a threaded section meshing with the internally threaded bore of the sight adjustment block, such that rotation of the sight adjustment shaft causes lateral sliding movement of the sight adjustment block with respect to the frame to thereby adjust the lateral position of the sight with respect to the slide. An upper hex-shaped depression is operably associated with the sight adjustment shaft for engagement with the hand tool to thereby facilitate rotation of the sight adjustment shaft and thus lateral adjustment of the sight with respect to the slide. The hand tool includes an L-shaped hex wrench with a first short hex-shaped leg and a second long hex-shaped leg, with at least one of the hex-shaped legs being engageable with the lower and upper hex-shaped depressions to thereby facilitate rotational movement of the clamping member and the sight adjustment shaft with a single tool, respectively, in clockwise and counterclockwise directions to thereby move the clamping member toward and away from the channel and the sight adjustment block in at least one of a right windage direction and left windage direction. With this arrangement, the lower clamping portion and upper sight adjustment portion are fully contained within the outer periphery of the frame to thereby minimize a size of the compact sight adjustment assembly.

BRIEF DESCRIPTION OF THE DRAWINGS

The following detailed description of the preferred embodiments of the present invention will be best understood when considered in conjunction with the accompanying drawings, wherein like designations denote like elements throughout the drawings, and wherein.

It is noted that the drawings are intended to depict exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
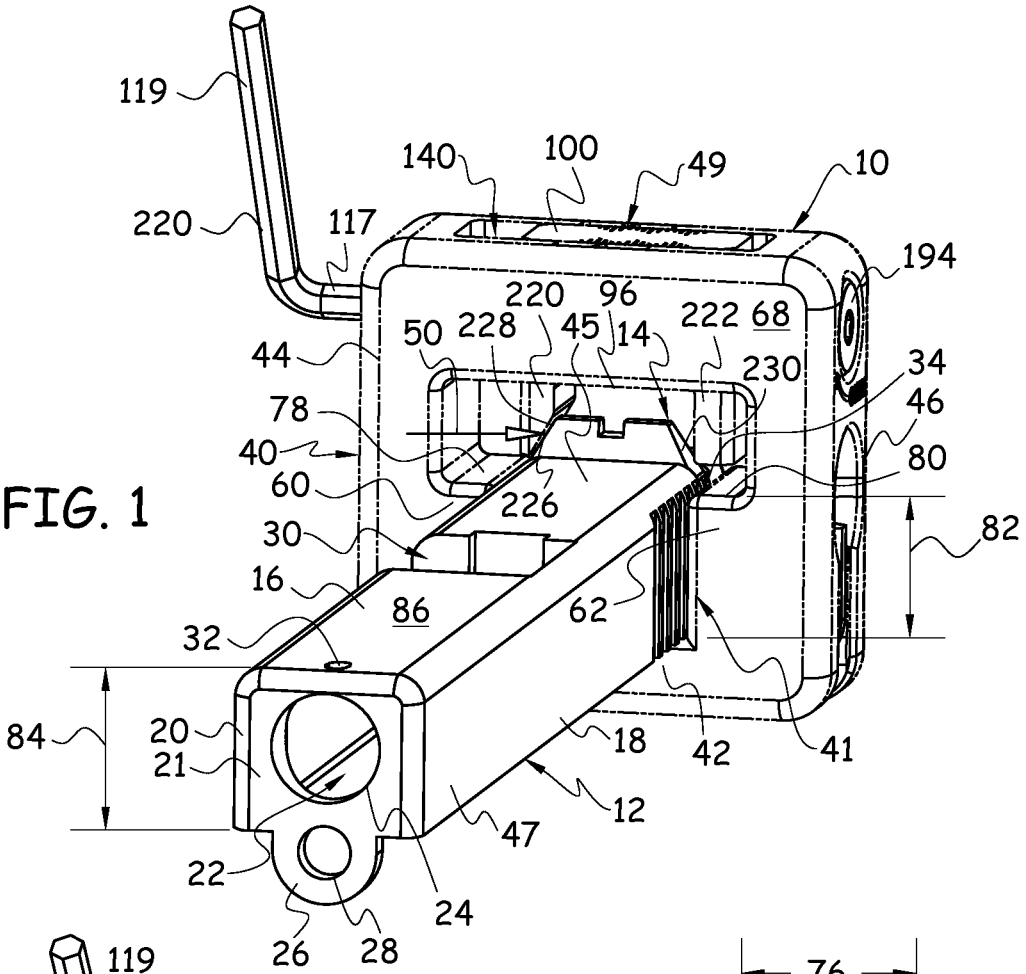
FIG. 1 is a left front isometric view of a portable sight adjustment assembly, in accordance with an exemplary embodiment of the invention, showing a handgun slide mounted therein with a rear sight thereof in alignment with an adjustment finger and the remainder of the slide extending forwardly from the sight adjustment assembly for adjusting the rear sight along a first lateral direction.
Figure 2:
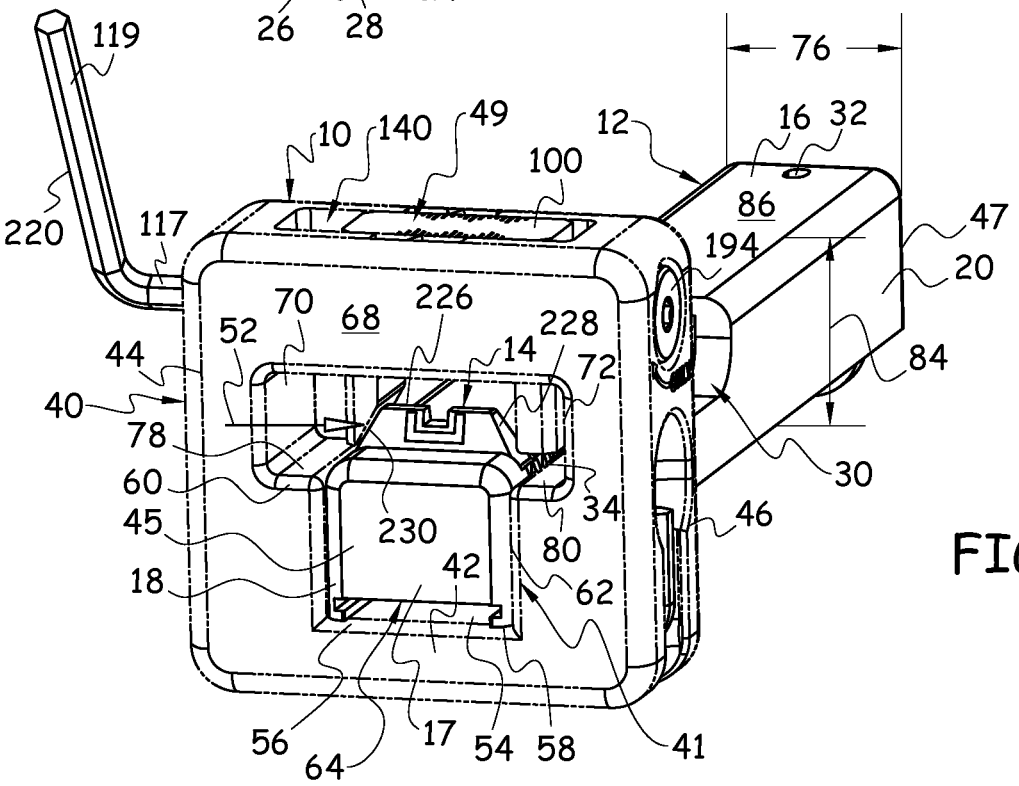
FIG. 2 is a left front isometric view of the sight adjustment assembly similar to FIG. 1 and showing a handgun slide mounted therein with a rear sight thereof in alignment with an adjustment mechanism and the remainder of the slide extending rearwardly from the sight adjustment assembly for adjusting the rear sight along a second lateral direction opposite the first lateral direction.

Referring now to the drawings, and more particularly to FIGS. 1 and 2, a sight adjustment assembly 10 for changing a lateral (windage) position of a sight 14 mounted on a slide 12 of a handgun, pistol, or other firearm (not shown) in accordance with an exemplary embodiment of the invention is illustrated.

Depending on the particular handgun where lateral or windage adjustment of the sight 14 with respect to the slide 12 is desired, the slide can come in a variety of widths, lengths and heights, as well as various shapes and configurations. The slide 12, as shown in FIGS. 1, 2, and 11-14 is configured for illustration purposes only and by way of example, for Glock® handgun models 17, 19, 22, 23, 24, 26, 27, 31-36, 41, and 45.

Although a particular slide for a particular handgun brand having different models is shown and described by way of example, it will be understood that the sight adjustment assembly 10 can be configured to accommodate any handgun slide having a wide variety of styles, configurations, features, and sizes without departing from the spirit and scope of the invention.

In order to minimize the complexity of the sight adjustment assembly 10 to ensure the assembly is sufficiently small, lightweight, and portable to be inconspicuously stored in a pocket, handgun case, or the like during transportation, such as when traveling to a particular location for operating the handgun, while ensuring that the user can consistently operate the sight adjustment assembly 10 to fine tune the position of one or more sights mounted on the slide 12 along the right or left windage directions, the number of parts are minimized when compared to prior art devices without compromising quality or accuracy, as will be described in greater detail below.

As best shown in FIGS. 1 and 2, the slide 12 typically includes a top plate 16, a left side plate 18 and a right side plate 20 extending downwardly from the top plate 16 at opposite longitudinal edges thereof, a rear slide cover 17 (FIG. 2) extending from the rear edge of the top plate 16 and between the rear edges of the side plates 18, 20, and a front slide cover 21 (FIG. 1) extending from the front edge of the top plate 16 and between the front edges of the side plates 18, 20 to form an interior 22 (FIG. 1) within which various components (not shown) of the handgun are housed for loading, firing, and ejecting a cartridge, and resetting the components for a new firing cycle. The front slide cover 21 includes an opening 24 (FIG. 1) for receiving the muzzle end of a barrel (not shown) and a tab 26 with a relatively small opening 28 for receiving a recoil spring assembly (not shown). A slot 30 is formed in the top plate 16 and the left side plate 20 (FIG. 1) to accommodate the loading and ejecting of cartridges during use. The top plate 16 of the slide 12 also includes a front aperture 32 near the muzzle end of the handgun for receiving a stationary front sight (not shown) and a rear dovetail-shaped groove 34 (FIGS. 1, 2, and 12) formed in the top plate 16 and extending laterally across the top plate between the side plates 18, 20 for receiving a dovetail-shaped mounting base 36 (FIG. 12) of the rear sight 14.

Although the sight adjustment assembly 10 of the invention will be primarily discussed in conjunction with adjusting the rear sight of a handgun having windage adjustment in opposing lateral directions due to the majority of slides having a dovetail-shaped groove formed in the top plate 16 and extending laterally across, and a majority of compatible sights having dovetail-shaped projections, it will be understood that the sight adjustment assembly can be used with other less common mounting arrangements to adjust the windage position of rear and/or front sights having the capacity for lateral adjustment with respect to a longitudinal direction of the slide 12.

In order to minimize the dimensions of the sight adjustment assembly 10 so that it can be easily stored or transported in the pocket of a user, handgun case, hung from a belt or belt loop using a strap (not shown) extending through the adjustment assembly 10, or other carrying or storage arrangement where compact storage is desirable, the sight adjustment assembly 10 is configured to allow only enough room to adjust or fine-tune the lateral position of a pre-installed sight, such as the rear sight 14, rather than a much larger device constructed of metal that would normally require secure mounting to a benchtop, vice, or the like for greater stability. Thus, the sight adjustment assembly of the present invention is particularly useful for making fine adjustments in the field during use for example, when it is determined that the sights are not perfectly aligned as discussed above.

Accordingly, prior to using the sight adjustment assembly 10 of the invention, the rear sight 14 and/or front sight (not shown) is/are typically preinstalled and aligned on the slide 12 during assembly at the factory. Likewise, when the rear sight 14 for example is swapped for another sight of the same type or different configuration, the installation of the swapped sight takes place prior to using the sight adjustment assembly, so that the sight adjustment assembly 10 can be used for fine tuning the lateral or windage position of the rear sight 14 with respect to the front sight (not shown) with respect to a longitudinal axis (not shown) of the handgun barrel (not shown) without the use of extra hand tools that must be separately carried and thus have the potential of becoming lost.

Thus, the sight adjustment assembly 10 is especially suitable for use in the field or other remote location where sophisticated tooling and adjustment devices are not available or would be too impractical to carry into the field, where it is desirable or necessary to correct sight misalignment, which can happen when the sights have not been adequately aligned at the factory, a gunsmith shop, or other location due to hasty workmanship, when different ammunition is used, when user preferences such as the style of grip is modified or changed, a user's particular eyesight or change in eyesight which may change the point of impact, or when the sights become misaligned during transportation or use under repeated firing and cycling of the slide which may cause slight lateral movement of the rear sight over time, as well as misalignment mishaps when the front and/or rear sight is inadvertently bumped or dropped, or improperly aligned through the use of unsuitable tools that do not allow fine adjustment as previously described, as well as when changes to the barrel or slide occur.

The slide 12 is normally mounted to the handgun (not shown), such as a semi-automatic pistol, and is typically spring-loaded to bias the slide forward, i.e. toward the muzzle end of the barrel. The slide 12 also functions as the bolt when the firing pin hits the primer to block the breech end of the barrel chamber when the primer of a cartridge is activated by a firing pin located within the slide, causing the abrupt and explosive expansion of gas, which in turn causes the slide to move rearward against the spring bias. This explosive rearward movement causes the extractor, which is also housed in the slide 12, to eject the spent casing from the chamber and reset the firing pin by cocking the hammer or striker back toward the firing position. As the slide 12 reverses direction and cycles forward under spring bias, a new cartridge is automatically moved from a magazine clip attached to the handgun and pushed into the chamber for the next firing cycle. Since the rear sight is mounted to the slide 12, there exists the possibility for small, virtually unnoticed movement of the rear sight with respect to the slide 12 due to constant fore and aft cycling of the slide, until the user begins to notice inconsistencies between the shots, especially during long training sessions, other situations where the handgun may be used, or simply over time, or when accidently bumped, etc.

With additional reference to FIGS. 3-10, the sight adjustment assembly 10 includes a generally square-shaped frame 40 with a lower slide clamping portion 41 having a lower cross beam or base member 42 adapted for receiving and securing a rear breech end 45 (FIG. 1) or a front muzzle end 47 of the handgun slide 12 (FIG. 2) with the rear sight 14 and/or front sight (not shown) pre-installed on the slide depending on which sight is to be adjusted, and an upper sight adjusting portion 49 having an upper cross beam 51 located above the lower slide clamping portion 41 and extending parallel with the lower cross beam or base member 42 for moving the sight 14 in a left windage direction, as represented by arrow 50 in FIG. 1, and a right windage direction, as represented by arrow 52 in FIG. 2. When the rear sight 14 is being adjusted, the breech end 45 of the slide 12 is inserted into the frame 40 from either the front side of the frame 40, as shown in FIG. 1, or from the rear side of the frame 40, as shown in FIG. 2. The frame 40 also includes a right side post 44 spaced from a left side post 46, and each side post extends between the base member 42 of the clamping portion 41 and the upper cross beam 51 of the upper sight adjusting portion 49.

The lower slide clamping portion 41 includes the lower cross beam or base member 42 with a surface or floor 54 that receives and supports lower surfaces or edges 56 and 58 (FIG. 2) of the side plates 18 and 20, respectively, of the slide 12. A right side step 60 extends inwardly from the right side post 44 and a left side step 62 extends inwardly toward from the left side post 46 to form a relatively narrow clamping channel 64 for receiving and holding the slide 12 in conjunction with other components of the clamping portion 41, as will be described in greater detail below. Preferably, the clamping channel 64 extends completely through the thickness 95 (FIGS. 6 and 7) of the frame 40 between a rear wall 66 and front wall 68 thereof. A first inner surface 70 of the right side step 60 and a second inner surface 72 of the left side step 62 define an inside width 74 (FIG. 3) that is approximately equal to or slightly greater than an outside width 76 (FIGS. 2, 11) of the slide 12 as measured between the outer surfaces of the side plates 18, 20 of the slide 12, so that the slide fits snugly in the channel 64 with the lower surfaces 56 and 58 of the side plates 18 and 20, respectively, resting on the surface or floor 54 of the base member 42. In this manner, little to no clamping force may need to be applied against the side plates of the slide while adjusting the sight 14 along the laterally extending dovetail groove 34 or other known structure formed in the in the top plate 16 of the slide 12 for holding and allowing adjustment of the sight with respect to the slide.

A top right surface 78 of the right side step 60 and a top left surface 80 of the left side step 62 both define an upper open end of the channel 64. Each top surface 78, 80 is located at a particular height above the floor 54 of the lower cross beam 42, which defines a channel height or depth 82 (FIGS. 1, 5, 12) as measured between the floor 54 of the cross beam 42 and the top surfaces 78 and 80. In accordance with one aspect of the invention, the depth 82 of the clamping channel 64 is less than or equal to a height 84 (FIGS. 1, 2, and 12) of the slide 12, as measured between the lower surfaces 56 and 58 of the side plates 18 and 20, respectively, and the top surface 86 of the top plate 16. Preferably, the depth 82 of the clamping channel 64 is slightly less than the height 84 of the slide 12, so that the base 36 of the sight 14 is accessible when needed for adjusting the windage position of the sight with the sight adjustment assembly 10 of the invention.

An upper adjustment gap 90 is also formed in the frame 40 and is defined by a volume comprising a width 91 (FIG. 5) extending between the inner right surface 92 of the right side post 44 and the inner left surface 94 of the left side post 46, a height 93 extending between the top surfaces 78 and 80 of the right and left steps 60 and 62, respectively, and a lower surface 96 of the upper cross beam 51, and a depth 95 (FIGS. 6 and 7) extending between the front surface 66 and the rear surface 68 of the frame 40.

The width 91 of the upper adjustment gap 90 is preferably longer than the width 74 of the channel 64 to allow a predefined lateral range of movement for a sight adjustment block 100 connected to the frame 40 for linear movement to adjust a windage position of the sight 14. Moreover, the height 93 of the upper adjustment gap 90 is preferably shorter than the height 82 of the channel 64 yet sufficiently long to accommodate taller sights, such as sight 14B in FIG. 14.

Although the width 91 of the upper adjustment gap 90 can be of any practical length to allow the sight to be completely installed on the slide 12 and adjusted as needed, or completely removed from the slide without departing from the spirit and scope of the invention, the width 91 is preferably limited in dimension to allow only lateral adjustment of the sight 14 with respect to the slide 12 by limiting the linear movement of the sight adjustment block 100 within the upper adjustment gap 90 in order to ensure the sight adjustment assembly of the invention is as small as possible to fit in a user's pocket, a small handgun case or the like, as previously described, so that the sight adjustment assembly can be carried into the field for sight adjustment as needed without the need to carry or transport other tools that may be too cumbersome, or become separated and lost as in prior art devices.

In accordance with a preferred embodiment of the invention, the sight adjustment assembly 10 is also arranged to be relatively lightweight when compared to prior art devices to further increase the portability of the sight adjustment assembly 10. The frame 40 therefore preferably comprises one or more lightweight materials sufficiently strong to resist relatively high compressive and tensile forces, as well as bending moments, that may occur between the slide 12 and the frame 40 when clamped in the channel 64, between the frame 40 and the lower clamping mechanism 41 when a slide 12 is clamped in the channel 64, and between the upper sight adjusting portion 49 and the frame 40 due to high forces transferred therebetween during sight adjustment in either windage direction. Suitable materials can include, but are not limited to composite or compound materials, such as polymers, plastics, thermoplastics, non-polymer materials, and so on, reinforced with woven or random short and/or long glass fibers, carbon fibers and/or Kevlar fibers and so on. Composites are ideal for the frame 40 because they are much softer than the steel slide 12, and therefore will not scratch the slide during operation. Other suitable materials can include composite honeycomb structures, syntactic foams including plastic or ceramic materials embedded with plastic, glass, or carbon microspheres, and so on. Although particular materials and combinations of materials have been described, it will be understood that the frame 40 can be constructed of any suitable material, including for example aluminum or other metals, ceramics, plastics, polyurethane material, etc., without departing from the spirit and scope of the invention.

The frame 40 can be further strengthened without compromising portability and weight of the sight adjustment assembly 10 by configuring the gap 64 to snugly receive the width of one or more slides 12 of similar width associated with one or more handguns or handgun models by a single manufacturer. In this manner, the frame 40, and thus the sight adjustment assembly 10 can be provided for a particular slide or series of slides from the same manufacturer having similar dimensions, e.g. similar outside widths, while the outside heights may be allowed to vary so long as there is no interference between the upper sight adjusting portion 49 and the slide when properly installed and secured in the clamping channel 64.

Therefore, in accordance with one aspect of the invention, a sight adjustment assembly can be provided with a clamping channel width that is approximately equal to an outside width of a particular slide or series of slides having similar outside widths so that the slides are snugly to slightly loosely received in the clamping channel. For one or more handgun models having one or more slides with a greater outside width, a different sight adjustment assembly 10 can be provided, with a clamping channel 64 configured to accommodate the wider slide dimension. In this manner, frames that are compact, light, and sturdy can be provided in accordance with the invention, such frames being particularly well suited for different slide configurations while ensuring that the slide, the sight, and the sight adjustment mechanism are not damaged under the very high forces applied during adjustment of the sight in a lateral direction with respect to the slide.

The sight adjustment assembly 10 of the present invention is particularly suitable as a dedicated apparatus for a single slide or a series of slides from a single manufacturer having similar width and height dimensions. Accordingly, several different sight adjustment assemblies 10 can be provided, with each assembly being dedicated to a particular slide or set of slides having the same or similar dimensions from the same handgun manufacturer or even different manufacturers with similarly dimensioned slides. Each clamping channel 64 of different sight adjustment assemblies 10 will therefore be dimensioned differently to accommodate the particular slide or set of slides having a particular width and/or height. The upper adjusting mechanism 49 of each dedicated sight adjustment assembly can also be configured for the particular slide and sights available for that slide. In this manner, a selection of different sight adjustment assemblies for a selection of different handgun slides can be provided. It will be understood that the particular size of the clamping channel will depend on the particular size of the handgun slide(s) that the dedicated sight adjustment assembly 10 is modified to accommodate. Accordingly, a dedicated sight adjustment assembly 10 normally used for one manufacturer having one or more handgun models with similar slide dimensions, can be used for other manufacturers and/or other handgun models where the slides of such manufacturers and/or models having similar dimensions allow them to fit within the clamping channel 64.

In order to increase the resistance to the high forces required to adjust the sight in a lateral direction, the lower clamping portion 41 and the upper sight adjusting portion 49 can be configured to maximize areas of contact between the frame 40 and the slide 12, and between the sight 14 and the upper sight adjusting portion 49, respectively. In addition, the frame 40 can be further strengthened by rounding the corners between frame surfaces to thereby increase a surface area at the corners or intersections of frame surfaces to reduce concentrated stresses, for example by providing fillets or chamfers at critical corners of the frame 40 that may be subjected to higher stresses.

With particular reference to FIGS. 3, 4, and 9 to 12, the lower clamping portion 41 comprises the lower cross beam or base member 42 with the surface or floor 54 that receives and supports lower surfaces or edges 56 and 58 (FIG. 2) of the side plates 18 and 20, respectively, of the slide 12. A first lower clamping bore 102 is formed in the frame 40 and extends through the right side step portion 60 from a right side outer surface 104 of the right side post 44 to the inner surface 70 of the step portion 60.

A threaded insert 106 is pressed or otherwise inserted or formed in the lower clamping bore 102 and includes outer flat surfaces 108 of a hexagonal shape that engage corresponding surfaces (not shown) in the bore 102 to prevent rotation of the threaded insert 106. Internal threads 110 (FIGS. 9, 10, and 12) are formed in the insert 106 for receiving a clamping screw 112, comprising a set screw with external threads 114 formed along a length thereof for engaging the internal threads 110 of the insert 106 and an engagement tip 116 located at one end of the set screw 112 that can be integrally formed if the set screw is constructed of relatively softer material than the slide material, such as, but not limited to, soft steel, aluminum, brass, and other softer metals. Alternatively, the engagement tip 116 can be formed separately and secured to the tip of the set screw 112, such materials including, but not limited to nylon, brass, plastic, rubber, silicon, or other material having a lower hardness rating than the material forming the side plates 18, 20 (FIGS. 1 and 2) of the slide 12 to thereby prevent marring or scratching the slide when clamped. A hex-shaped hollow 118 (FIG. 9) is formed in the opposite end of the set screw 112 for receiving a first end 117A of a short hex-shaped leg 117 or a second end 119A of a long hex-shaped leg 119 of an L-shaped hex wrench 120 or other tool to facilitate movement of the set screw 112 toward and away from the lower clamping channel 64. When the material of the frame 40 is constructed of sufficiently durable material, the threaded insert can be replaced with integrally formed threads in the bore 102

Figure 12:
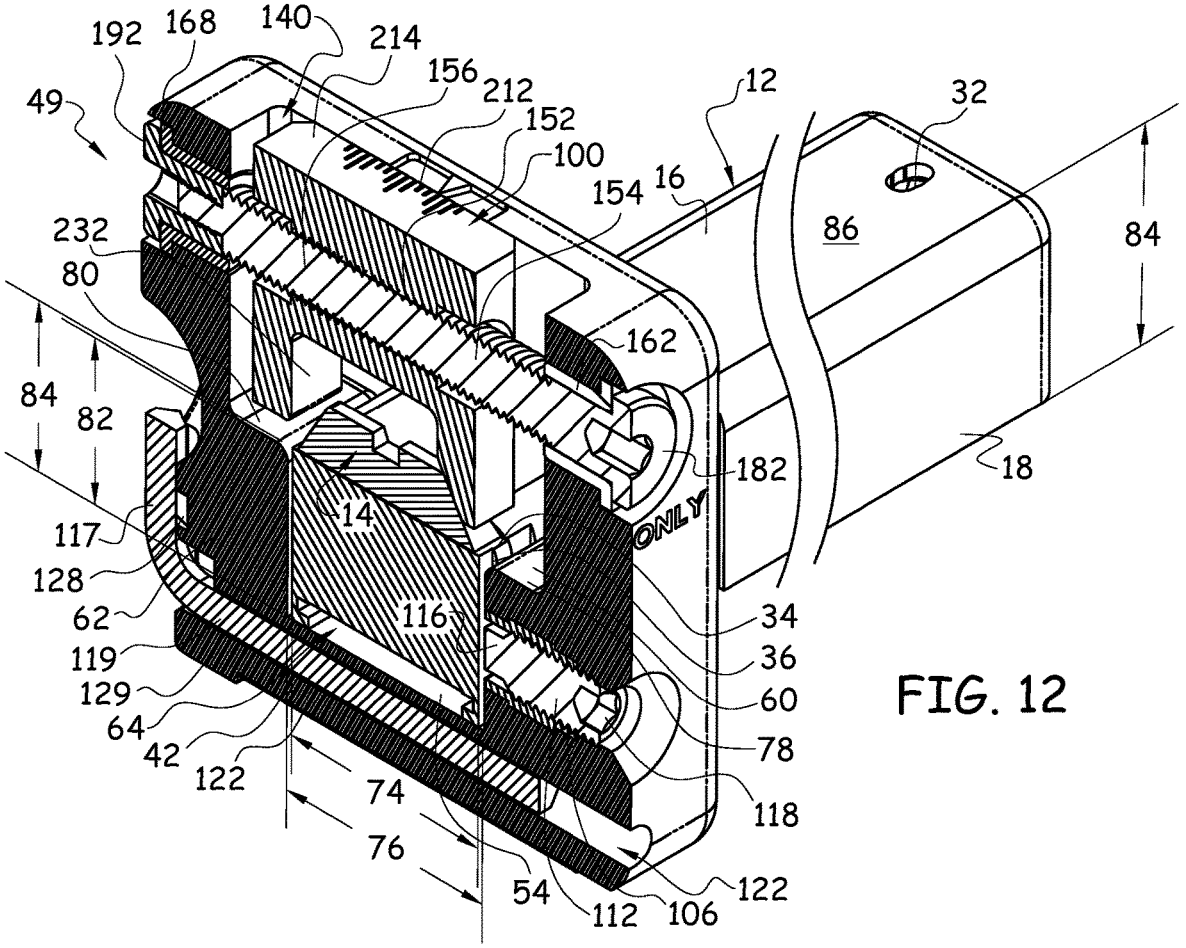
FIG. 12 is an isometric cross-sectional view taken along line 10-10 of FIG. 11 showing a cut-away view of the mounted handgun slide extending rearwardly therefrom.

When not in use, such as during transportation or storage, the long leg 119 of the hex wrench 120 is normally stored in an elongate lower storage space 122 that, as best shown in FIG. 12, extends horizontally through the base member 42 from a keyhole-shaped storage cavity 124 formed in the left side outer surface 126 of the left side post 46, to the right side outer surface 104 (FIG. 9) of the right side post 44.

Figure 4:
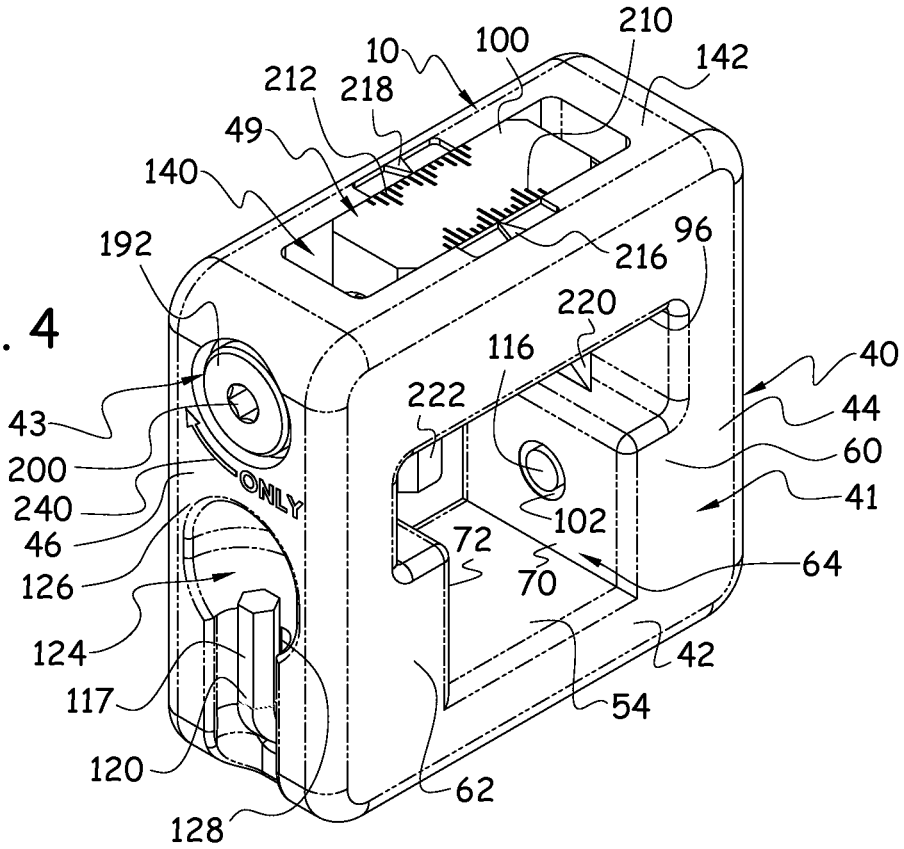
FIG. 4 is a left rear isometric view of the sight adjustment assembly of FIG. 3.
Figure 7:
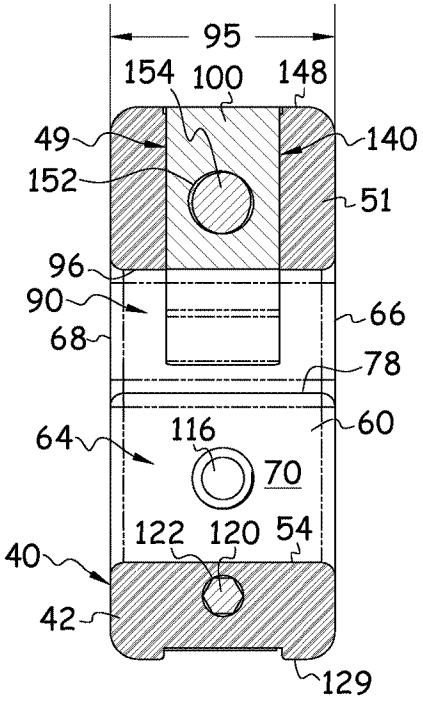
FIG. 7 is a cross-sectional view of the sight adjustment assembly taken along line 7-7 of FIG. 5.
Figure 5:
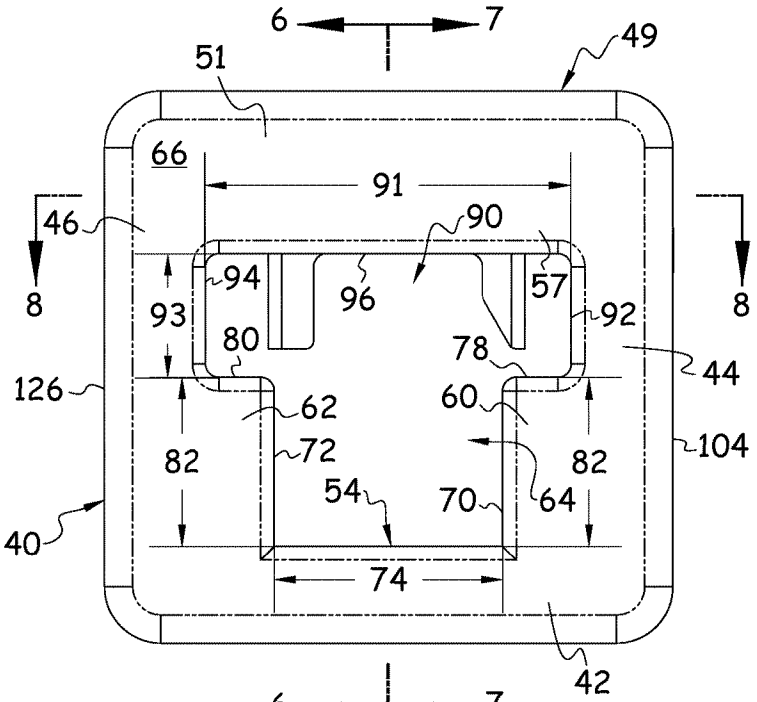
FIG. 5 is a rear elevational view of the sight adjustment assembly of FIG. 3.
Figure 8:
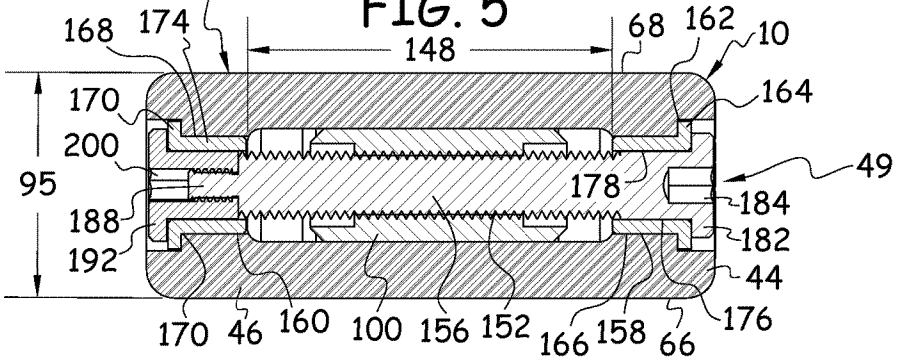
FIG. 8 is a cross-sectional view of the sight adjustment assembly taken along line 8-8 of FIG. 5.
Figure 6:
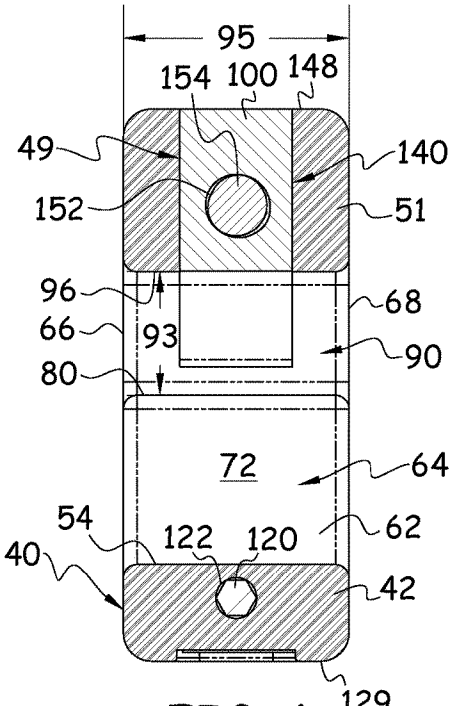
FIG. 6 is a cross-sectional view of the sight adjustment assembly taken along line 6-6 of FIG. 5.
Figure 9:
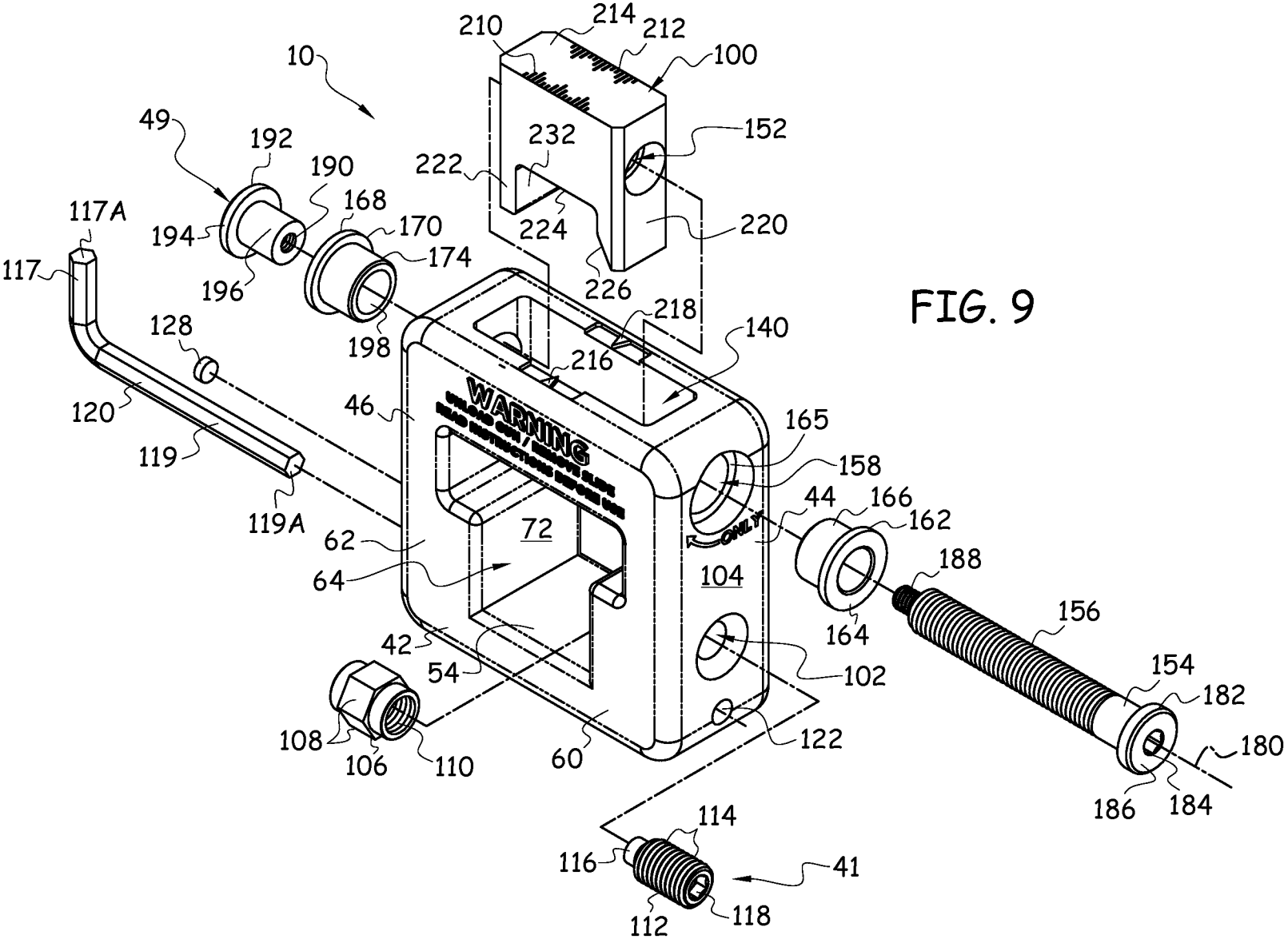
FIG. 9 is a right rear isometric exploded view of the sight adjustment assembly.
Figure 10:
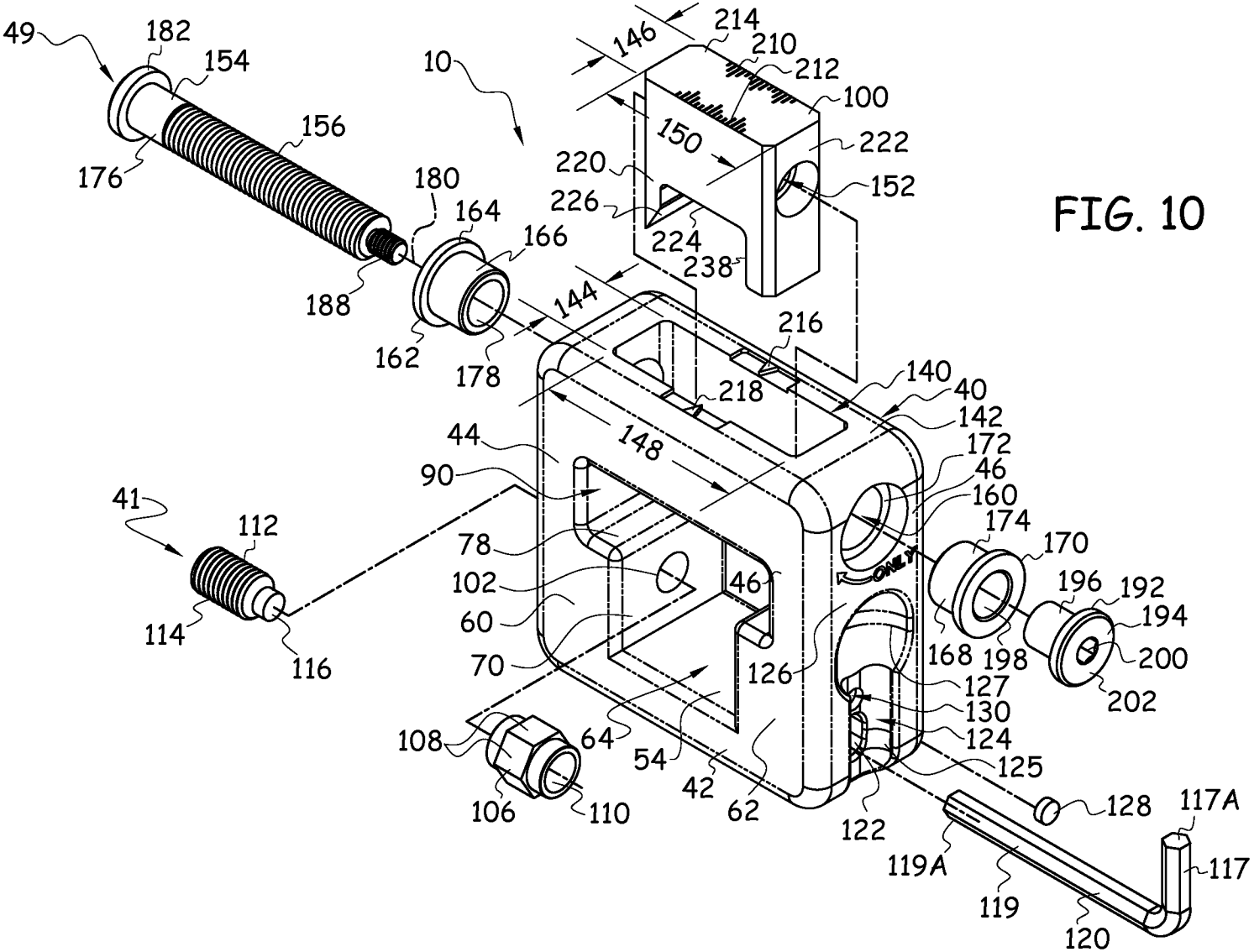
FIG. 10 is a left front isometric exploded view of the sight adjustment assembly.
Figure 11:
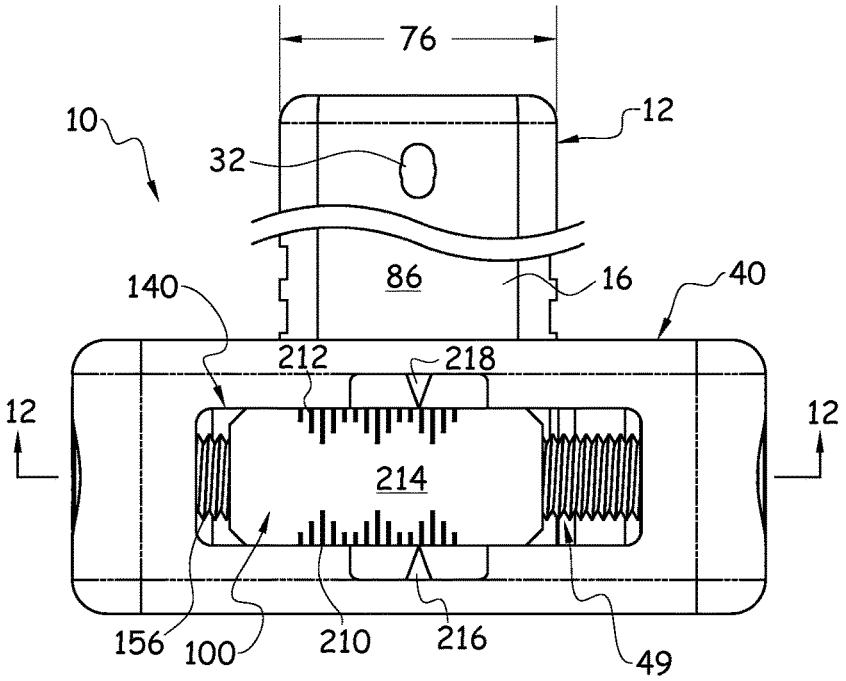
FIG. 11 is a top plan view of the sight adjustment assembly with a shortened view of a mounted handgun slide extending rearwardly therefrom.

As best shown in FIGS. 4 and 10, the storage cavity 124 has a lower cavity section 125 that extends upwardly from the lower surface 129 (FIGS. 6, 7, and 12) of the base member 42 and intersects with the lower storage space 122 for receiving the short leg 117 of the hex wrench when the long leg 119 is inserted into the lower storage space. The storage cavity 124 also has an upper cavity section 127 that is generally semi-spherical in shape for receiving the first end 117A of the short leg 117 and is sufficiently wide to permit a user to grasp the hex wrench 120 with the thumb and finger of the right or left hand, for example, and remove the hex wrench 120 by pulling the long leg 119 outwardly of the lower storage space 122. The storage cavity 124 is preferably sufficiently deep to ensure that the short leg 117 does not protrude beyond the outer side surface 126 of the frame 40 when the tool 120 is stored in the frame 40 as shown in FIG. 4, for minimizing the size of the sight adjustment assembly and for ensuring that the tool does not snag on outside objects, inadvertently fall out, and become lost.

A small disk-shaped magnet 128 is located in a correspondingly-shaped depression 130 (FIG. 10) formed within the storage cavity 124 and secured therein through adhesive bonding, press-fitting or other well-known securing means. The magnet 128 serves to hold the short leg 117 of the hex wrench 120 within the keyhole-shaped storage cavity 124 with the long leg 119 located in the lower storage bore.

It will be understood that the magnet 128 can be replaced with other holding means, such as a clip formed integrally with the frame 40 within the tool storage cavity 124 that grasps the short leg 117 in a snap-fit engagement, other clips, fasteners, clamps, flexible loops, as well as other fastening means that can be separately formed and attached to the frame 40 in the storage cavity 124, so that such fastening means do not extend beyond the outer surface 12.

In accordance with yet a further embodiment of the invention, a cover can be provided for closing and opening the storage cavity 124. The cover can be hinged, slid, clipped, or otherwise separately formed and attached to the frame 40 for ensuring the tool 120 stays in its stored position when the fastening means is in the closed position.

It will be understood that the tool storage space 122 need not extend completely through the width of the frame 40, but can alternatively be formed as a blind hole that terminates at a position spaced from the outer surface. It will be further understood that the hex wrench and/or clamping screw 112 with accompanying threaded insert, magnet or other holding means, can be located in the opposite side of the frame 40 without departing from the spirit and scope of the invention.

As best shown in FIGS. 9-12, the upper sight adjusting portion 49 includes a slot 140 formed in the upper cross beam 51 between the lower surface 96 and the upper surface 142 thereof. The slot has a thickness 144 that approximates the thickness 146 of the sight adjustment block 100 and a length 148 that is longer than the length 150 of the sight adjustment block to enable linear sliding movement in opposing windage directions while minimizing or eliminating fore and aft play between the sight adjustment block 100 and the slot 140. An internally threaded bore 152 (FIG. 12) extends through the length of the sight adjustment block 100 for meshing with a threaded section 156 of a sight adjustment shaft 154 or drive screw spanning the length 148 of the slot 140. A first stepped opening 158 (FIG. 9) is formed in the right side post 44 and extends between the right side outer surface 104 and the inner right surface 92. Likewise, a second stepped opening 160 (FIG. 10) is formed in the left side post 46 and extends between the left side outer surface 126 (FIG. 5) and the left side inner surface 94. A first annular bearing 162 is located in the first stepped opening 158 and includes an annular head portion 164 resting against a stepped section 165 (FIG. 9) of the opening 158 and a first hollow cylindrical bearing body 166 extending through the stepped section. Likewise, a second annular bearing 168 is located in the second stepped opening 160 and includes an annular head portion 170 resting against a stepped section 172 (FIG. 10) of the opening 160 and a second hollow cylindrical bearing body 174 extending through the stepped section 172.

The sight adjustment shaft 154 has a cylindrical non-threaded bearing section 176 that engages an inner bearing surface 178 of the first annular bearing 162 to allow rotation of the adjustment shaft 154 about its central axis 180 (FIG. 10). A first drive head section 182 is located adjacent to the bearing section 176 of the adjustment shaft 154 and a hex-shaped hollow 184 (FIG. 9) is formed in the flat out surface 186 of the first drive head section 182 for receiving the first end 117A of the short hex-shaped leg 117 or the second end 119A of the long hex-shaped leg 119 of the L-shaped hex wrench 120 or other tool to facilitate rotational movement of the threaded section 156 of the adjustment shaft 154 in the clockwise and counterclockwise directions to thereby move the sight adjustment block 100 in the left or right windage directions.

Likewise, the opposite end of the adjustment shaft 154 has a reduced threaded outer section 188 that engages an internal threaded section 190 of a fastener 192. The fastener 192 includes a second drive head section 194 that rests against the annular head portion 170 of the second annular bearing 168 and a bearing shaft section 196 extending from the drive head section 194 that engages an inner bearing surface 198 of the second annular bearing 168 to allow rotation of the drive head section 194 about the central axis 180, with the internal threaded section 190 being coaxial and coincident with the bearing shaft section 196 and mated with the reduced threaded outer section 188 tightened against the internal threaded section 190 so that the entire drive shaft 154 is rotatable about the central axis 180 and moves the sight adjustment block 100 in opposing windage directions. A hex-shaped hollow 200 (FIG. 10) is formed in the flat outer surface 202 of the drive head section 194 for receiving the first end 117A of the short hex-shaped leg 117 or the second end 119A of the long hex-shaped leg 119 of the L-shaped hex wrench 120 or other tool to facilitate rotational movement of the threaded section 156 of the adjustment shaft 154 in the clockwise and counterclockwise directions to thereby move the sight adjustment block 100 in the right or left windage directions with a high degree of precision.

The sight adjustment block 100 includes windage scales 210 and 212 (FIG. 9) located on an upper surface 214 thereof. Likewise, pointers 216 and 218, respectively, are integrally formed with the upper surface 142 of the upper cross beam 51 to check a first or original position of the sight adjustment block with respect to the frame 40 just prior to adjusting the sight and subsequent relative positions during adjustment of the sight.

A first adjustment leg 220 and a second spaced adjustment leg 222 extend downwardly from a lower surface 224 of the sight adjustment block 100 for engaging different sight configurations. The first adjustment leg 220 includes a first sight engagement surface 226 that is slanted or chamfered to match the chamfered surface 228 on one side of the rear sight 14, as shown in FIG. 1, for adjustment of the rear sight 14 in the first direction as represented by arrow 50.

Likewise, the second adjustment leg 222 includes a second sight engagement surface 232 has a straight or flat contact surface that is shaped to match the straight or flat side surfaces 233 of a rear sight 14A (FIG. 13) or the flat side surfaces 235 of a rear sight 14B (FIG. 14) for example. With respect to sight 14B in FIG. 14, which is representative of taller sights, the length of the second adjustment leg 222 with the flat engagement surface 232 can also be used to adjust such sights.

Figure 3:
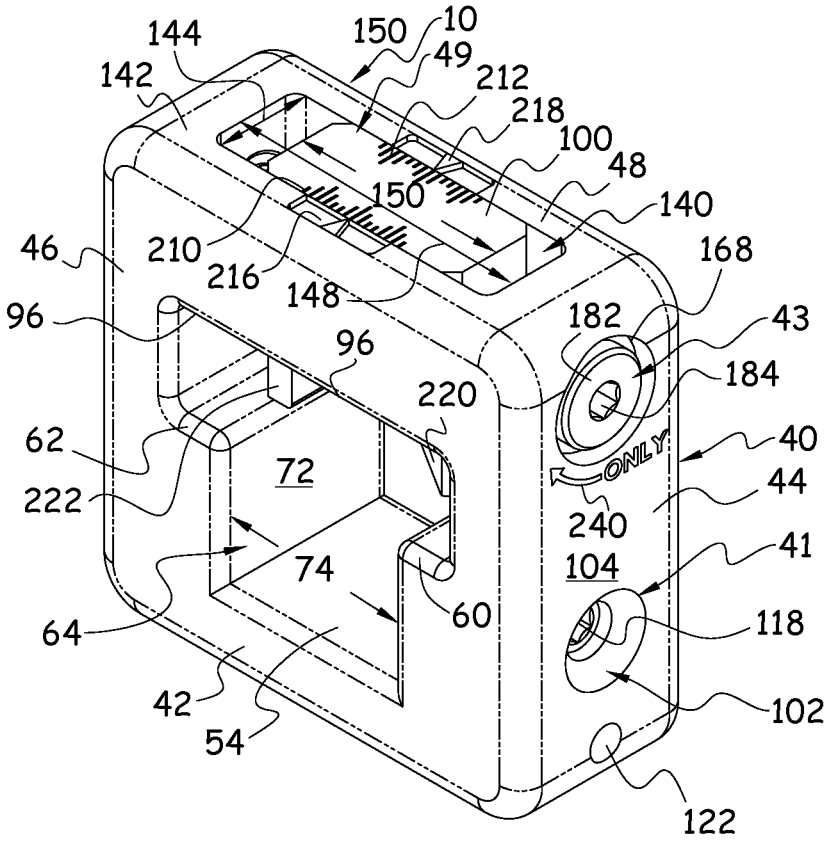
FIG. 3 is a right rear isometric view of a portable sight adjustment assembly in accordance with an exemplary embodiment of the invention.

When it is desirous or becomes necessary to adjust the rear sight 14 in the opposite second direction, as represented by arrow 52 in FIG. 2, the slide 12 is removed and installed in the sight adjustment assembly 10 in the opposite direction of the FIG. 1 installation so that the chamfered surface 226 of the first adjustment leg 220 matches the opposite chamfered surface 230 of the rear sight 14, as shown in FIG. 2, for windage adjustment in the second direction 52 by rotation of the hex wrench 120 in the clockwise direction, as shown in FIGS. 3 and 4 for example, but may additionally or alternatively be adjusted in the counterclockwise direction without departing from the spirit and scope of the invention.

Figure 13:
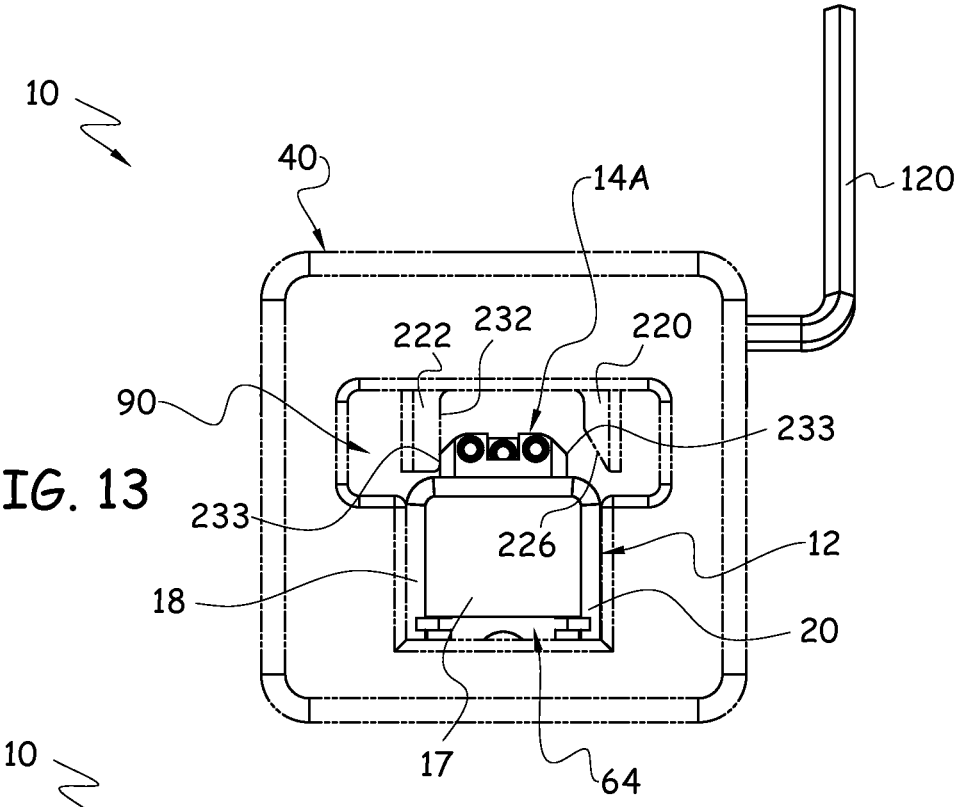
FIG. 13 is a rear elevational view of the sight adjustment assembly and showing a handgun slide mounted therein with the remainder of the slide extending rearwardly therefrom for laterally adjusting an illuminated rear sight having a different configuration than the rear sight shown in FIG. 12 for example.
Figure 14:
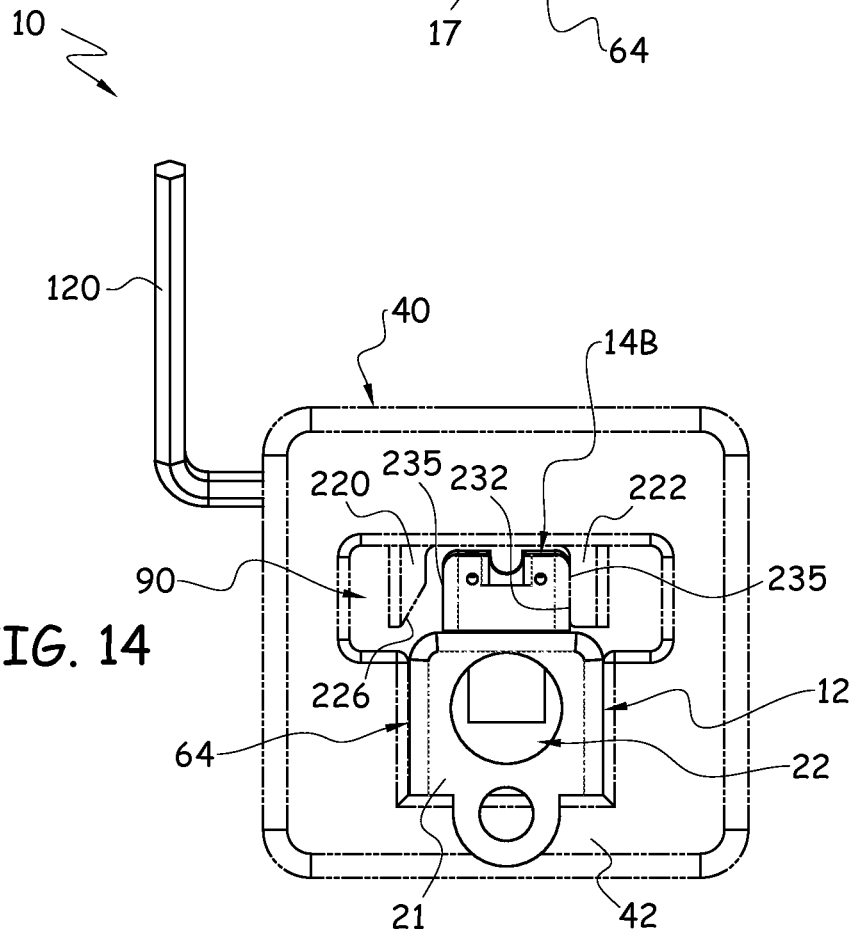
FIG. 14 is a front elevational view of the sight adjustment assembly and showing a handgun slide mounted therein with the remainder of the slide extending forwardly therefrom for laterally adjusting a rear sight having a different configuration than the previously illustrated sights.

Referring now to FIGS. 13 and 14, the sight adjustment block with the depending adjustment legs 220 and 222 with their sight engagement surfaces 226 and 232, respectively, together with the height of the adjustment gap 90 and the length and orientation of the adjustment legs and surfaces, besides the adjustment of OEM rear sights 14 shown in the previous FIGS. 1 and 2 for example, as illuminated sights 14A in FIG. 13 can be engaged with either the chamfered surface 226 of the first adjustment leg 220 or the straight contact surface 232 of the second adjustment leg 222. In addition as described above, taller sights such as sight 14B in FIG. 14, can be accommodated by the surface 232 of the adjustment leg 222 to thereby provide means for adjusting a variety of different sights and slides for different handguns, as long as the slides have similar slide widths and heights.

Although the above-described embodiment does not have adjustability for handgun slides or the like of different sizes, adjustability can be provided without compromising the overall size of the sight adjustment assembly by making the right side step 60 and left side step 62 adjustable in the lateral direction, for example, such as providing spring-loaded clamping plates that adjust automatically in the horizontal direction to the width of the particular slide being adjusted, and which can be locked in place through fasteners or the like once the proper clamping gap has been achieved. Likewise, the lower cross beam 42 and/or upper cross beam 51, as well as the length and configuration of the adjustment legs can also be modified with vertically adjustability to accommodate slides and sights of different configurations and heights.

Accordingly, it will be understood that the invention is not particularly limited to dedicated fixed sized frames for particular slides. However, when fixed frames are provided, as described above and shown in the various drawing figures, several sight adjustment assemblies can be provided for accommodating many different slide and sight configurations and sizes, as previously described.

Moreover, in accordance with a further embodiment of the invention, dedicated sight adjustment assemblies 10 can be provided in kit form with different sized clamping channels and other features configured for different sized slides and different sight configurations.

In accordance with yet a further embodiment of the invention, the sight adjustment block 100 can also be modified to accommodate other sight configurations. For example, the adjustment legs with sight engagement surfaces can differ in height, shape, orientation, and size to accommodate a variety of different sights and sight/slide combinations.

It is further contemplated, in accordance with a further embodiment of the invention, that the sight adjustment block 100 can be replaceable with other sight adjustment blocks having different configurations for accommodating different sight configurations that might not normally be associated with the particular slide, especially when specialized or custom sights have been or are being installed. The sight adjustment blocks can be removable and replaceable by configuring the adjustment shaft to be removable from the frame 40 so that another sight adjustment block can be inserted in the frame and engaged with the threaded portion of the adjustment shaft.

In use, when it is desirous to adjust the sight associated with a handgun or other firearm, such as the rear sight 14 of a handgun, the slide 12 associated with the handgun, as previously described, is removed from the handgun in a known manner as indicated by the gun manufacturer. Any screws or fasteners used to secure the rear sight to the slide are then removed. The clamping set screw 120 is then loosened sufficiently, if needed, so that the breech end of the slide 12 can be installed from either the front side of the sight adjustment assembly 10 or from the rear side thereof depending on which direction the sight should be adjusted in. The clamping screw 112 is then rotated in the clockwise direction until the slide 12 is firmly held in the clamping channel 64 without damaging the slide.

The scales 210, 212 on the sight adjustment block 100 and pointers 214, 218 on the upper cross beam 51 are beneficial for informing the user of the magnitude of relative movement between the sight and the slide during adjustment. The units or markings on the scales 210 and 212 can be similar or different and/or offset from each other to achieve a Vernier-type measurement of relative movement with high accuracy. The scales 210, 212 can be referenced in any known measurement units to match the known amount of offset the rear sight currently has or may need to have depending on several factors, such as current offset amount between the front and rear sights, the wind speed and distance to target that must be compensated for to ensure shooting accuracy during sustained wind conditions, for example, the particular handgun being used, as well as type of ammunition used and the velocity of the projectile once fired, changes in temperature extremes, and so on.

When the desired offset is known or can be measured with instruments or based on experienced observation, calculated values or look-up tables for the particular set of shooting conditions, either through direct measurement or experienced observation, the rear sight can be adjusted the exact amount by rotating the hex wrench 220 in the clockwise direction, as shown for example by the instructional indicia 240 printed or engraved or adhered to the right side wall 44 (FIG. 3) and instructional indicia 242 (FIG. 4) printed or engraved or adhered to the left side wall 46, until the correct position on the scale(s) 210, 212 matches with the pointers 216 and 218.

Once the slide 12 is secured against movement in the clamping channel 64, the hex wrench 120 is removed from the clamping screw 112 and inserted into one of the hex-shaped hollows 184, 200 of the opposing heads 182, 192 of the adjustment shaft 154. It will be understood that other configurations besides hex wrenches engaging hex-shaped hollows can be used without departing from the spirit and scope of the invention. for engaging the clamping screw 112 and adjustment shaft 154 are within the scope of the invention.

With the above-described sight adjustment assembly 10 having a lightweight, fixed frame formed of a composite material and with an adjustable clamping portion and sight adjustment portion provided only inside of the frame, together with the hex wrench or other tool for affecting the clamping and sight adjustments being stored in a secure position within the confines of the frame, it has been possible to construct relatively small sight adjustment assemblies that can fit within the pocket of a user, a handgun case, or other small area while allowing relatively wide adjustability of varying sight configurations for slides of generally similar widths and heights, as is common among similar models of handguns produced by the same manufacturer and different manufacturers.

In accordance with an exemplary embodiment of the invention, the sight adjustment mechanism has been constructed with the frame 40, rounded to the nearest 0.1 inch, having a width of approximately 2.5 inches, a height of approximately 2.5 inches, and a thickness or depth of approximately 1.0 inch, without compromising strength or the capacity of the upper adjustment mechanism to adjust the right or left windage positions of a rear sight relative to a front sight or other reference installed on the top plate of a handgun slide under the high forces required to adjust the position of the rear sight while preventing damage to the handgun slide.

Although a particular frame size has been given by way of example, it will be understood that the width, height, and thickness of the frame, as well as the clamping gap and adjusting gap and related components can greatly vary without departing from the spirit and scope of the invention. It will be further understood that the invention is not limited to a square-shaped frame, but encompasses frames of different geometrical configurations, such as rectangular, triangular, circular, as well as multi-sided shapes including but not limited to pentagonal frames, hexagonal frames, various combinations thereof, etc.

It will be understood that the term "preferably" as used throughout the specification refers to one or more exemplary embodiments of the invention and therefore is not to be interpreted in any limiting sense. In addition, terms of orientation and/or position as may be used throughout the specification, such as horizontal, vertical, upper, lower, right, left, front, rear, and so on, as well as their derivative and equivalent terms, denote relative, rather than absolute, orientations and/or positions.

It will be appreciated by those skilled in the art that changes could be made to the embodiments described above without departing from the broad inventive concept thereof. It will be understood, therefore, that this invention is not limited to the particular embodiments disclosed, but also covers modifications within the spirit and scope of the present invention as defined by the appended claims.

We claim:

1. A compact sight adjustment assembly for adjusting a lateral position of an iron or metal sight connected to a slide operably associated with a handgun, the sight adjustment assembly comprising:

a frame with an outer periphery;

an enclosed adjusting space located within the frame for receiving a sight connected to the slide;

a sight adjustment mechanism operably associated with the frame and including a sight adjusting portion operably associated with the sight and adapted for movement in a lateral direction with respect to the frame within the enclosed adjusting space for adjusting a lateral position of the sight with respect to the slide; and a lower clamping portion, the lower clamping portion including a lower hex-shaped depression operably associated with a clamping member for engagement with a hex-shaped tool, wherein the sight adjustment mechanism is fully contained within the outer periphery of the frame to thereby minimize a size of the compact sight adjustment assembly.

2. A compact sight adjustment assembly according to claim 1, and further comprising:

an enclosed clamping space located within the outer periphery of the frame for receiving an end portion of the slide therein; and a clamping mechanism operably associated with the frame and the enclosed clamping space for clamping the end portion of the slide against lateral movement in the clamping space;

wherein the clamping mechanism is fully contained within the outer periphery of the frame to thereby minimize the size of the compact sight adjustment assembly.

3. A compact sight adjustment assembly according to claim 2, and further comprising a hand tool located within the outer periphery of the frame when in a stored condition, the hand tool being removable from the frame and operably associated with at least one of the sight adjustment mechanism and the clamping mechanism to thereby adjust at least one of a lateral position of the sight and a clamping force against the end portion of the slide, respectively.

4. A compact sight adjustment assembly according to claim 3, wherein the hand tool is operably associated with both the sight adjustment mechanism and the clamping mechanism to thereby minimize the number of hand tools required for both adjusting the sight and clamping the slide.

5. A compact sight adjustment assembly according to claim 4, wherein the sight adjusting portion comprises:

a sight adjustment block retained within the outer periphery of the frame for movement in the lateral direction to thereby contact and adjust the lateral position of the sight with respect to the slide; an internally threaded bore extending laterally through the sight adjustment block;

a sight adjustment shaft connected to the frame within the outer periphery and having: a bearing section connected to the frame for rotation about a central axis of the sight adjustment shaft; and a threaded section meshing with the internally threaded bore of the sight adjustment block, such that rotation of the sight adjustment shaft causes lateral sliding movement of the sight adjustment block with respect to the frame to thereby adjust the lateral position of the sight with respect to the slide.

6. A compact sight adjustment assembly according to claim 5, wherein the sight adjustment shaft further comprises a first drive head section connected to a first end of the sight adjustment shaft within the outer periphery of the frame for engagement with the hand tool to thereby facilitate rotation of the sight adjustment shaft and thus lateral adjustment of the sight with respect to the slide.

7. A compact sight adjustment assembly according to claim 6, wherein the sight adjustment shaft further comprises a second drive head section associated with a second end of the sight adjustment shaft within the outer periphery of the frame for engagement with the hand tool to thereby facilitate rotation of the sight adjustment shaft and thus lateral adjustment of the sight with respect to the slide.

8. A compact sight adjustment assembly according to claim 7, and further comprising: a hex-shaped hollow formed in at least one of the first and second drive head sections; and wherein the hand tool comprises an L-shaped hex wrench having a first short hex-shaped leg and a second long hex-shaped leg, with at least one of the hex-shaped legs being engageable with the hex-shaped hollow to thereby facilitate rotational movement of the threaded section of the sight adjustment shaft in the clockwise and counterclockwise directions to thereby move the sight adjustment block in at least one of a right windage direction and left windage direction with a high degree of precision.

9. A compact sight adjustment assembly according to claim 8, and further comprising: an elongate hex-shaped bore extending laterally into the frame for receiving the long hex-shaped leg when in a non-use position; and a depression formed in the frame and intersecting with the elongate hex-shaped bore for receiving the short hex-shaped leg; wherein the depression is sufficiently deep to ensure the short hex-shaped leg stays within the outer periphery of the frame when in a stored position.

10. A compact sight adjustment assembly according to claim 9, and further comprising a magnet located in the depression for retaining the L-shaped hex wrench within the outer periphery of the frame when in the stored position.

11. A compact sight adjustment assembly according to claim 6, wherein the frame comprises: a lower cross beam operably associated with the clamping mechanism and adapted for receiving and securing at least one of a rear breech end and a front muzzle end of the slide; an upper cross beam operably associated with the sight adjustment mechanism and extending parallel with the lower cross beam; a right side post extending between the lower cross beam and the upper cross beam; and a left side post spaced from the right side post and extending between the lower cross beam and the upper cross beam.

12. A compact sight adjustment assembly according to claim 11, wherein the sight adjustment shaft extends between and is rotatably connected to the right and left side posts.

13. A compact sight adjustment assembly according to claim 12, and further comprising a slot formed in the upper cross beam with a width and a length; wherein the slot width is approximately equal to a thickness of the sight adjustment block, and the slot length is longer than a length of the sight adjustment block to enable linear sliding movement in opposing windage directions while minimizing fore and aft play between the sight adjustment block and the slot.

14. A compact sight adjustment assembly according to claim 13, wherein the lower cross beam comprises: a floor that receives and supports a lower surface of the slide; a right side step extending inwardly from the from the right side post and upwardly from the floor; and a left side step extending inwardly from the left side post and upwardly from the floor; and a clamping channel formed between the right side step and the left side step for receiving and holding the slide.

15. A compact sight adjustment assembly according to claim 14, wherein the clamping channel extends completely through a thickness of the frame between a rear wall and front wall thereof, with a first inner surface of the right side step and a second inner surface of the left side step defining an inside width that is approximately equal to or slightly greater than an outside width of the slide, so that the slide fits snugly in the channel with the lower surface of the slide resting on the floor of the lower cross beam, to thereby minimize a lateral clamping force required against the slide for retaining the slide during adjustment of the sight.

16. A compact sight adjustment assembly according to claim 15, wherein slide clamping mechanism further comprises: a clamping bore formed in at least one of the left and right side step portions and extending therethrough; internal threads operably associated with the clamping bore; the clamping member having external threads formed along a length thereof for engaging the internal threads of the clamping bore; an engagement tip located at one end of the clamping member for engaging the slide when located in the clamping channel; wherein the clamping member is rotatable about a first direction for clamping the slide within the clamping channel and rotatable about a second direction for releasing the slide from the clamping channel.

17. A compact sight adjustment assembly according to claim 16, and further comprising: a first hex-shaped hollow formed in the first drive head section; the hand tool comprises an L-shaped hex wrench having a first short hex-shaped leg and a second long hex-shaped leg, with at least one of the hex-shaped legs being engageable with at least one of the first hex-shaped hollow and the lower hex-shaped depression to thereby facilitate rotational movement of at least one of the sight adjustment shaft and the clamping member.

18. A compact sight adjustment assembly for adjusting a lateral position of a sight connected to a slide operably associated with a handgun, the sight adjustment assembly comprising: a frame defining an outer periphery and comprising: a lower cross beam; an upper cross beam spaced from the lower cross beam and extending parallel with the lower cross beam; a right side post extending between the lower cross beam and the upper cross beam; and a left side post spaced from the right side post and extending between the lower cross beam and the upper cross beam; a lower clamping portion comprising: a lower clamping channel formed in the lower cross beam for receiving and securing at least one of a rear breech end and a front muzzle end of the slide; a lower internally threaded clamping bore formed in at least one of the right and left side posts and extending into the channel; a clamping member having external threads formed along a length thereof for engaging the internal threads of the clamping bore; and a lower hex-shaped depression operably associated with the clamping member for engagement with a hex-shaped tool; an upper sight adjustment portion comprising: a sight adjustment block having an internally threaded bore; a sight adjustment shaft rotatably connected to the right and left side posts and including a threaded section meshing with the internally threaded bore of the sight adjustment block, such that rotation of the sight adjustment shaft causes lateral sliding movement of the sight adjustment block with respect to the frame to thereby adjust the lateral position of the sight with respect to the slide; an upper hex-shaped depression operably associated with the sight adjustment shaft for engagement with the hand tool to thereby facilitate rotation of the sight adjustment shaft and thus lateral adjustment of the sight with respect to the slide; and a hand tool comprising an L-shaped hex wrench having a first short hex-shaped leg and a second long hex-shaped leg, with at least one of the hex-shaped legs being engageable with the lower and upper hex-shaped depressions to thereby facilitate rotational movement of the clamping member and the sight adjustment shaft, respectively, in clockwise and counterclockwise directions to thereby move the clamping member toward and away from the channel and the sight adjustment block in at least one of a right windage direction and left windage direction; wherein the lower clamping portion and upper sight adjustment portion are fully contained within the outer periphery of the frame to thereby minimize a size of the compact sight adjustment assembly.

19. A compact sight adjustment assembly according to claim 18, and further comprising: an elongate hex-shaped bore extending laterally into the lower cross beam for receiving the long hex-shaped leg when in a non-use position; and a depression formed in one of the left and right side posts of the frame and intersecting with the elongate hex-shaped bore for receiving the short hex-shaped leg; wherein the depression is sufficiently deep to ensure the short hex-shaped leg stays within the outer periphery of the frame when in a stored position.

* * * * *